US010022588B1

(12) United States Patent
Lee et al.

(10) Patent No.: US 10,022,588 B1
(45) Date of Patent: Jul. 17, 2018

(54) BODY EXERCISER

(71) Applicant: SUPERWEIGH ENTERPRISE CO., LTD., Nan-Tou Hsien (TW)

(72) Inventors: Sunny Lee, Nan-Tou Hsien (TW); Simon Chao, Nan-Tou Hsien (TW)

(73) Assignee: Superweigh Enterprise Co., LTD., Nan-Tou Hsien (TW)

( * ) Notice: Subject to any disclaimer, the term of this patent is extended or adjusted under 35 U.S.C. 154(b) by 0 days.

(21) Appl. No.: 15/626,459

(22) Filed: Jun. 19, 2017

(30) Foreign Application Priority Data

Feb. 20, 2017 (TW) ..... 106202415 U

(51) Int. Cl.
*A63B 22/04* (2006.01)
*A63B 23/035* (2006.01)
*A63B 24/00* (2006.01)

(52) U.S. Cl.
CPC ..... *A63B 22/04* (2013.01); *A63B 23/03525* (2013.01); *A63B 23/03583* (2013.01); *A63B 24/00* (2013.01)

(58) Field of Classification Search
CPC ..... A63B 22/0046; A63B 22/0664; A63B 2022/0676; A63B 2022/0682; A63B 2022/0688; A63B 23/035; A63B 23/03516; A63B 23/03525; A63B 23/03533; A63B 23/0355; A63B 23/03575; A63B 23/03591
See application file for complete search history.

(56) References Cited

U.S. PATENT DOCUMENTS 6,645,125 B1 * 11/2003 Stearns ..... A63B 22/001 482/52
7,520,839 B2 * 4/2009 Rodgers, Jr. ..... A63B 22/001 482/51
7,608,018 B2 * 10/2009 Chuang ..... A63B 22/001 482/52
8,029,416 B2 * 10/2011 Eschenbach ..... A63B 22/0017 482/52
8,092,351 B1 * 1/2012 Rodgers, Jr. ..... A63B 21/00181 482/51
8,814,757 B2 * 8/2014 Eschenbach ..... A63B 21/00069 482/52
9,579,537 B1 * 2/2017 Peng ..... A63B 22/0664
9,586,087 B1 * 3/2017 Lin ..... A63B 22/0664
9,757,609 B2 * 9/2017 Nishimura ..... A63B 22/001
9,827,461 B1 * 11/2017 Miller ..... A63B 22/0664
9,901,774 B2 * 2/2018 Miller ..... A63B 22/0664
9,950,209 B2 * 4/2018 Yim ..... A63B 22/0664
2008/0161163 A1 * 7/2008 Stewart ..... A63B 21/0051 482/51
2008/0261777 A1 * 10/2008 Chuang ..... A63B 22/001 482/52
2008/0261778 A1 * 10/2008 Chuang ..... A63B 22/001 482/52
2008/0261779 A1 * 10/2008 Chuang ..... A63B 22/001 482/52

(Continued)

*Primary Examiner* — Joshua Lee
(74) *Attorney, Agent, or Firm* — LeClairRyan

(57) ABSTRACT

A body exerciser includes two linking units each including a pedal rod which is suspended by a handle rod and a linking rod to be moved in a forward-and-rearward direction and in an upward-and-downward direction, and which is subjected to a resistance by a first resisting unit. The handle rod is swingable and subjected to a resistance by a second resisting unit, so that a variety of exercising modes selected by a user can be performed.

9 Claims, 7 Drawing Sheets

(56) References Cited

U.S. PATENT DOCUMENTS

2009/0105049 A1* 4/2009 Miller ..... A63B 22/001 482/52
2009/0181828 A1* 7/2009 Rodgers, Jr. ..... A63B 22/001 482/52
2010/0137110 A1* 6/2010 Rodgers, Jr. ..... A63B 21/151 482/52
2013/0035212 A1* 2/2013 Chuang ..... A63B 21/015 482/52
2013/0143720 A1* 6/2013 Chuang ..... A63B 22/0664 482/52
2014/0194255 A1* 7/2014 Huang ..... A63B 23/03591 482/52
2014/0194256 A1* 7/2014 Huang ..... A63B 22/0664 482/52
2014/0221166 A1* 8/2014 Huang ..... A63B 22/001 482/52
2014/0248998 A1* 9/2014 Lu ..... A63B 21/154 482/52
2014/0248999 A1* 9/2014 Lu ..... A63B 21/154 482/52
2014/0249000 A1* 9/2014 Lu ..... A63B 22/0664 482/52
2014/0274575 A1* 9/2014 Yim ..... A63B 22/001 482/52
2015/0202488 A1* 7/2015 Lo ..... A63B 22/001 482/52
2015/0335943 A1* 11/2015 Miller ..... A63B 22/0664 482/52
2015/0375030 A1* 12/2015 Yang ..... A63B 21/015 482/52
2016/0375300 A1* 12/2016 Chang ..... A63B 22/0664 482/52
2017/0014675 A1* 1/2017 Lai ..... A63B 22/0664
2017/0080282 A1* 3/2017 Lai ..... A63B 21/015

* cited by examiner

BODY EXERCISER

CROSS-REFERENCE TO RELATED APPLICATION

This application claims priority of Taiwanese Patent Application No. 106202415, filed on Feb. 20, 2017.

FIELD

The disclosure relates to a body exerciser, and more particularly to a body exerciser which is configured to perform different exercising modes selected by a user.

BACKGROUND

Conventional body exercisers can perform a wide variety of exercising modes. For example, a walking exerciser includes two swing rods pivotably mounted on a frame and having upper handgrip portions and lower pedal portions. A user grips the handgrip portions and treads on the pedal portions to swing the swing rods so as to simulate a walking on a flat ground. Also, a stair stepper machine includes two pedals movably supported on a base by a resistance. A user treads on the pedals and alternately exerts forces thereon to perform a stair-climbing exercising mode. Additionally, an elliptical machine includes a four-linkage structure to have two pedal rods movable along an elliptical route so as to perform a running exercising mode.

Each of the aforesaid exercisers, which can merely provide a certain exercising mode, is operable only for one purpose of exercise and is unable to build and strengthen various body muscle groups. Hence, all the above exercisers are needed to train different muscle groups, which results in space occupation and high cost.

SUMMARY

Therefore, an object of the disclosure is to provide a body exerciser that is operable under a wide variety of exercising modes selected by a user.

According to the disclosure, the body exerciser includes a frame unit, a first resisting unit, two linking units and a second resisting unit. The first resisting unit includes two cranks rotatably mounted on the frame unit, a first resisting member pivotably disposed on the frame unit, and a first transmitting mechanism connected between a respective one of the cranks and the first resisting member to permit synchronous rotation of the cranks and the first resisting member so as to provide a resistance to the cranks. Each of the linking units includes a handle rod which is pivotably connected to the frame unit to be swingable forwardly and rearwardly, a pedal rod which has a front portion pivotably connected to a lower end of the handle rod and which extends rearwardly from the front portion to have a middle portion and a rear portion, a swing rod which is pivotably connected to the frame unit, a first linking rod which is pivotably connected to the swing rod and the respective one of the cranks, a second linking rod which is pivotably connected between the swing rod and the pedal rod, and a connecting member which is pivotably connected to the handle rod. The second resisting unit includes a second resisting member which is pivotably disposed on the frame unit, and a second transmitting mechanism which is connected between the connecting member and the second resisting member to provide a resistance to the handle rod through the connecting member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
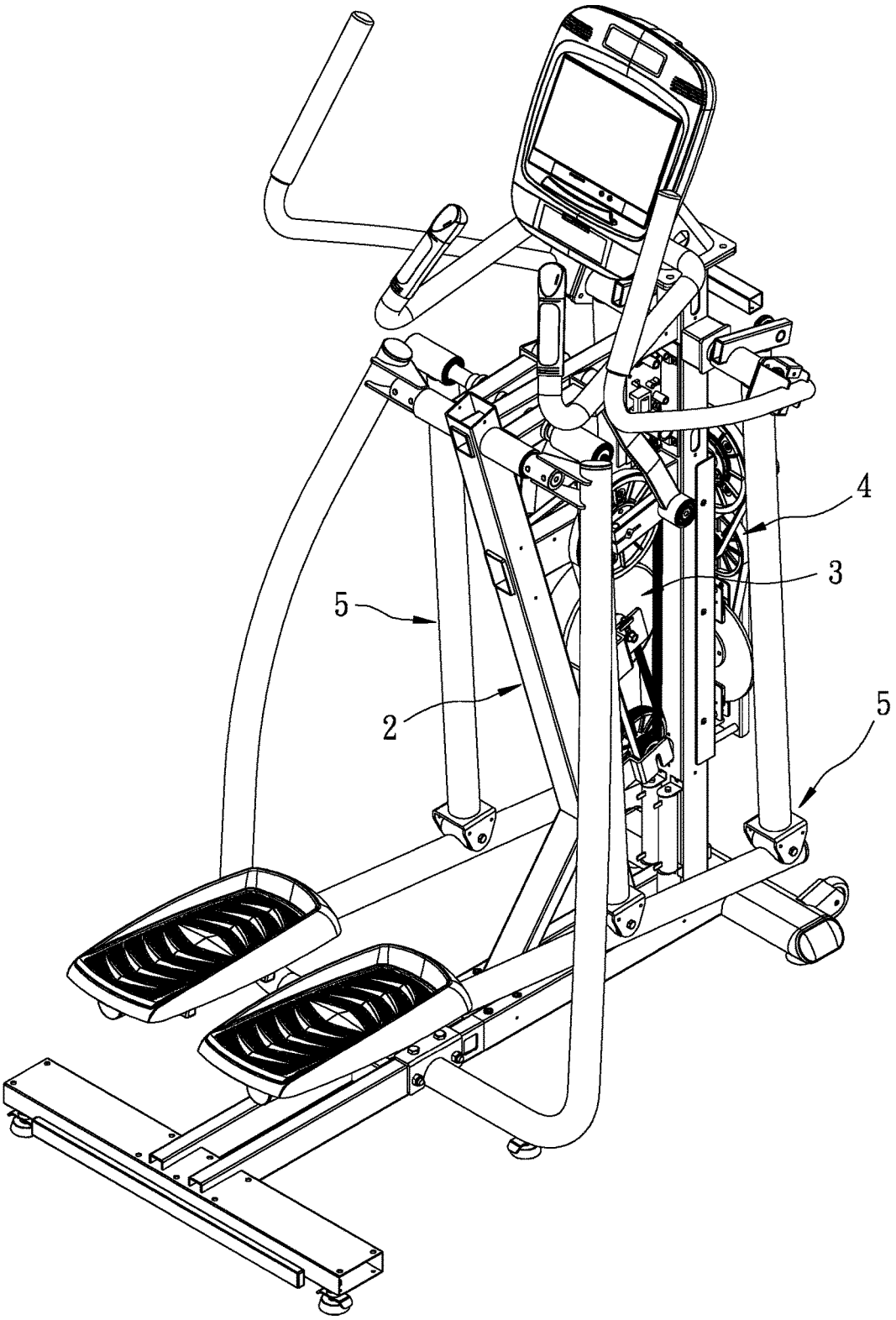
FIG. 1 is a perspective view illustrating an embodiment of a body exerciser according to the disclosure.
Figure 2:
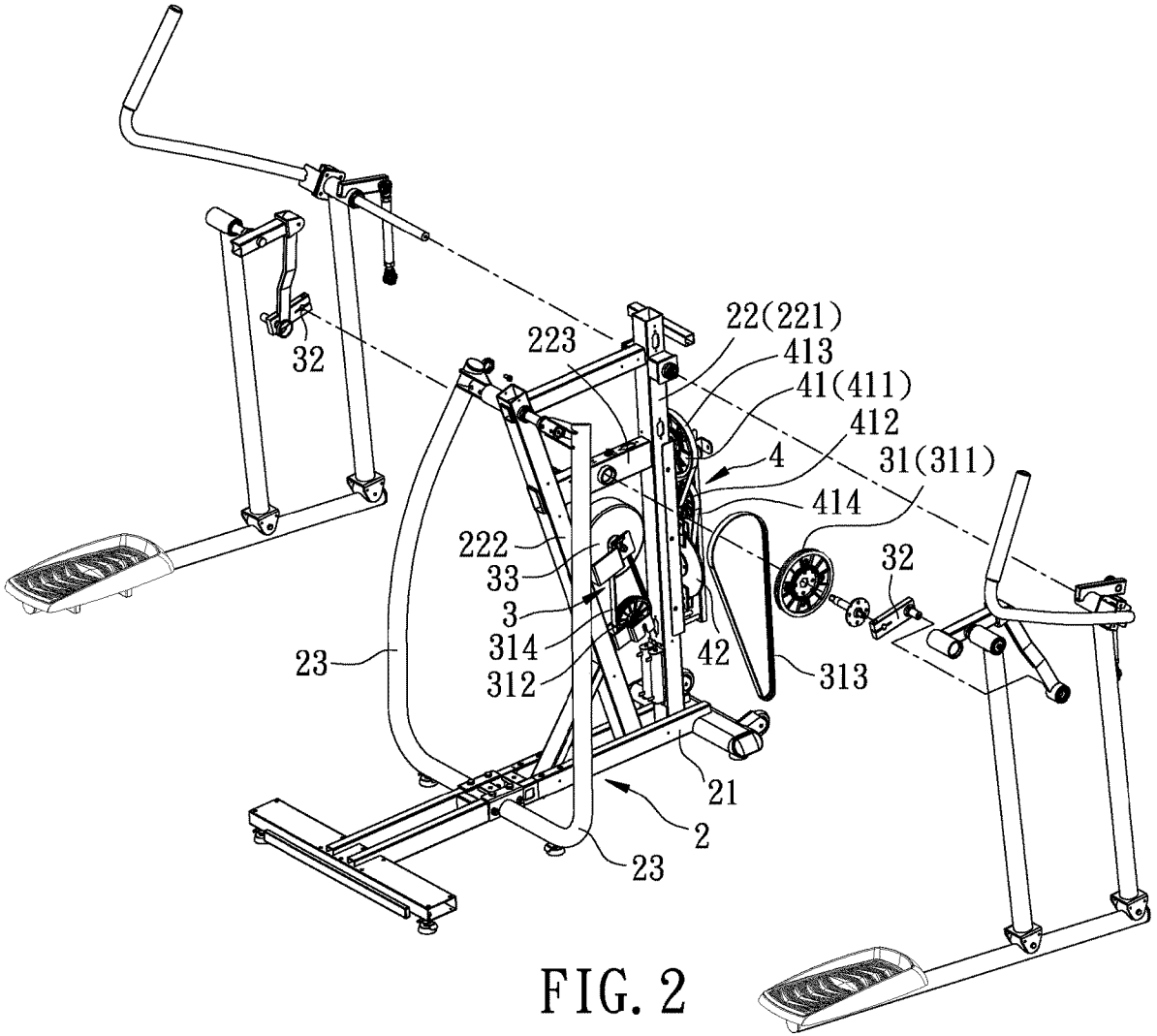
FIG. 2 is a partly exploded, perspective view of the embodiment.

Referring to FIGS. 1 and 2, an embodiment of a body exerciser according to the disclosure includes a frame unit 2, a first resisting unit 3, a second resisting unit 4 and two linking units 5.

The frame unit 2 includes a base 21, an upper front support 22 disposed on a front side of the base 21, and two lateral supports 23. The upper front support 22 includes a front rod section 221 which extends upwardly from the base 21, a rear rod section 222 which extends upwardly from the base 21 and which is disposed rearwardly of the front rod section 221, and a crosspiece section 223 which is connected between the front and rear rod sections 221, 222. Each of the lateral supports 23 is connected between the base 21 and an upper side of the rear rod section 222 and extends laterally of the base 21.

The first resisting unit 3 includes two cranks 32 which are pivotably connected to the crosspiece section 223 about an axis in a left-and-right direction, a first resisting member 33 which is pivotably connected to the rear rod section 222, and a first transmitting mechanism 31 which is connected between a respective one of the cranks 32 and the first resisting member 33 to permit synchronous rotation of the cranks 32 and the first resisting member so as to provide a resistance to the cranks 32. Specifically, the first transmitting mechanism 31 has a first primary wheel 311 which is pivotably connected to the crosspiece section 223 about the axis coaxial with that of the cranks 32, a first secondary wheel 312 which is pivotably connected to the rear rod section 222, a first primary belt 313 which is trained on the first primary and secondary wheels 311, 312, and a first secondary belt 314 which is trained on the first secondary wheel 312 and the first resisting member 33.

The second resisting unit 4 includes a second resisting member 42 which is pivotably connected to the front rod section 221 about an axis in a front-and-rear direction, and a second transmitting mechanism 41. The second transmitting mechanism 41 includes a second primary wheel 411 which is pivotably connected to the front rod section 221, a second secondary wheel 412 which is pivotably connected to the front rod section 221, a second primary belt 413 which is trained on the second primary and secondary wheels 411, 412, and a second secondary belt 414 which is trained on the second secondary wheel 412 and the second resisting member 42.

Figure 3:
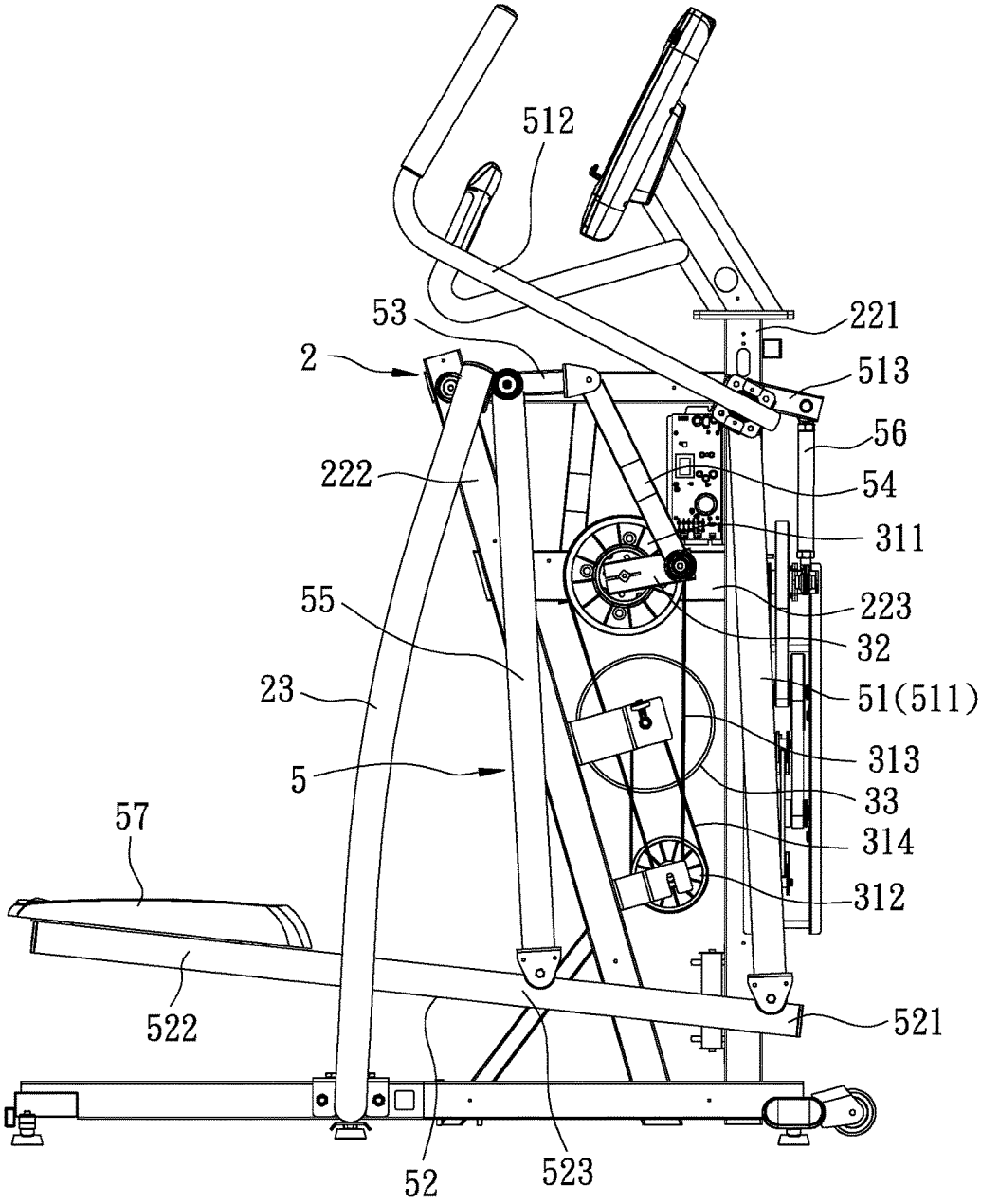
FIG. 3 is a side view of the embodiment.
Figure 4:
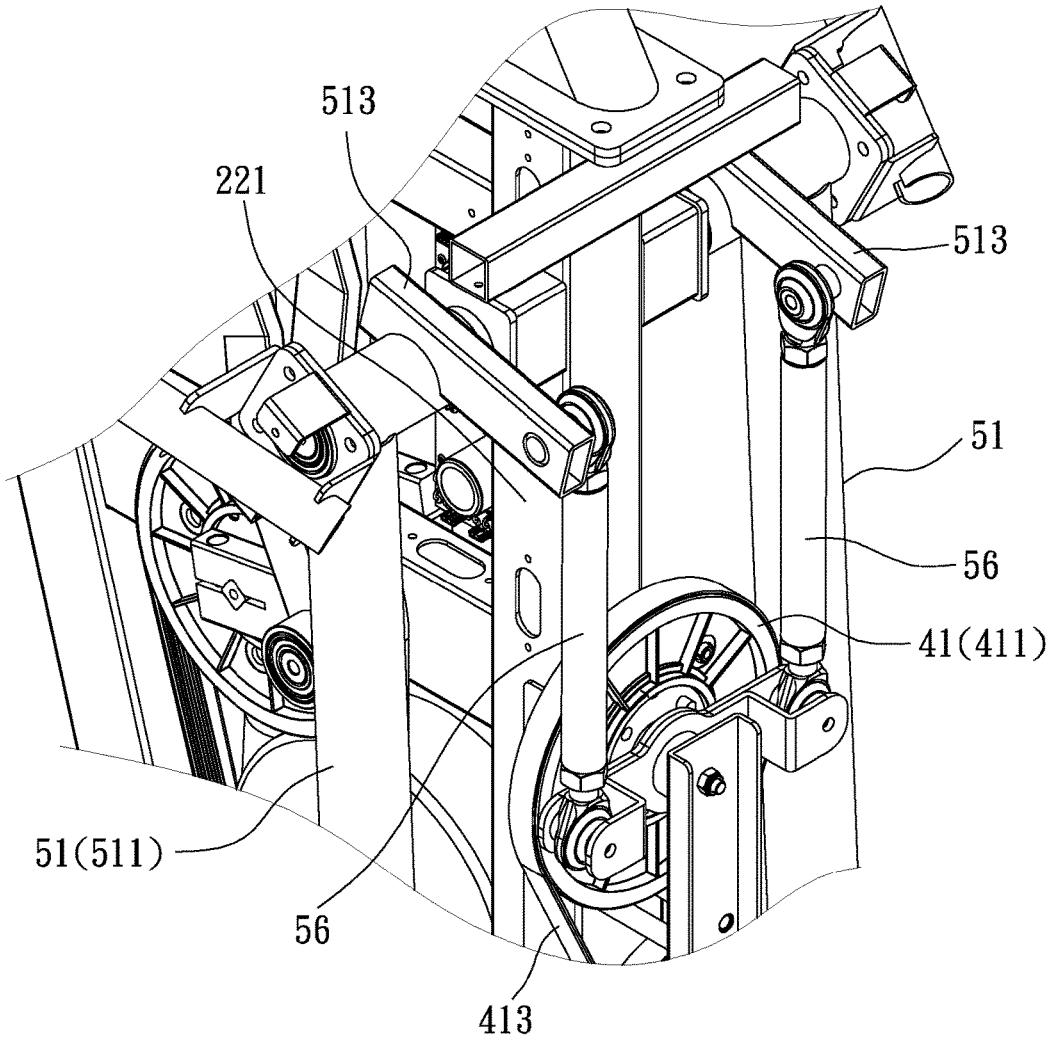
FIG. 4 is a fragmentary perspective view of a front portion of the embodiment.

Referring to FIGS. 3 and 4, each of the linking units 5 includes a handle rod 51 which is pivotably connected to the front rod section 221 to be swingable forwardly and rearwardly, a pedal rod 52 which has a front portion 521 pivotably connected to a lower end of the handle rod 51 and which extends rearwardly from the front portion 521 to have a middle portion 523 and a rear portion 522, a swing rod 53 which is pivotably connected to the rear rod section 222, a first linking rod 54 which is pivotably connected to the swing rod 53 and the respective crank 32, a second linking rod 55 which is pivotably connected between the swing rod 53 and the middle portion 523 of the pedal rod 52, a connecting member 56 which is pivotably connected between the handle rod 51 and the second transmitting mechanism 41, and a foot pedal 57 which is disposed on the rear portion 522 of the pedal rod 52. The handle rod 51 has a connecting portion 511 which is pivotably connected to the front rod section 221 and which has upper and lower ends, a handgrip portion 512 which is securely connected to the upper end of the connecting portion 511, and an extending portion 513 which is securely connected to and extends forwardly from the upper end of the connecting portion 511. The connecting member 56 has an end which is pivotably connected to a front end of the extending portion 513, and an opposite end which is pivotably connected to either one of left and right sides of the second primary wheel 411. In this embodiment, the ends of the connecting member 56 respectively have universal bearings pivotably connected to the handle rod 51 and the second transmitting mechanism 41, respectively. The second linking rod 55 has a lower end pivotably connected to the middle portion 523 of the pedal rod 52 for cooperating with the handle rod 51 to suspend the pedal rod 52.

When the user stands on the foot pedals 57 with hands grasping the handgrip portions 512 of the handle rods 51, and exerts forces on the foot pedals 57 in an alternating manner, the cranks 32 are rotated through the pedal rods 52, the second linking rods 55, the swing rods 53 and the first linking rods 54, and the first resisting member 33 is rotated as well by virtue of the first transmitting mechanism 31 to provide a resistance to the cranks 32 and to the pedal rods 52 so as to train the user's leg muscles. Since there is no linking connection between the handle rod 51 and the crank 32 on either side and each handle rod 51 is hence not affected by the first resisting member 33, the pedal rods 52 can be operated relative to the handle rods 51 with a higher degree of freedom so as to perform a variety of exercise modes selected by the user. In addition, each handle rod 51 is coupled with the second primary wheel 411 of the second resisting unit 4 through the respective connecting member 56. When the handle rods 51 are swung alternately, the second primary wheel 411 is brought into making an alternately clockwise and counterclockwise turning, which causes synchronous turning of the second resisting member 42 so as to provide the resistance to the handle rods 51. By virtue of the resistances to the handle rods 51 and to the pedal rods 52, the user performs the body exercise with a satisfactory feeling of comfort and smoothness.

Figure 5:
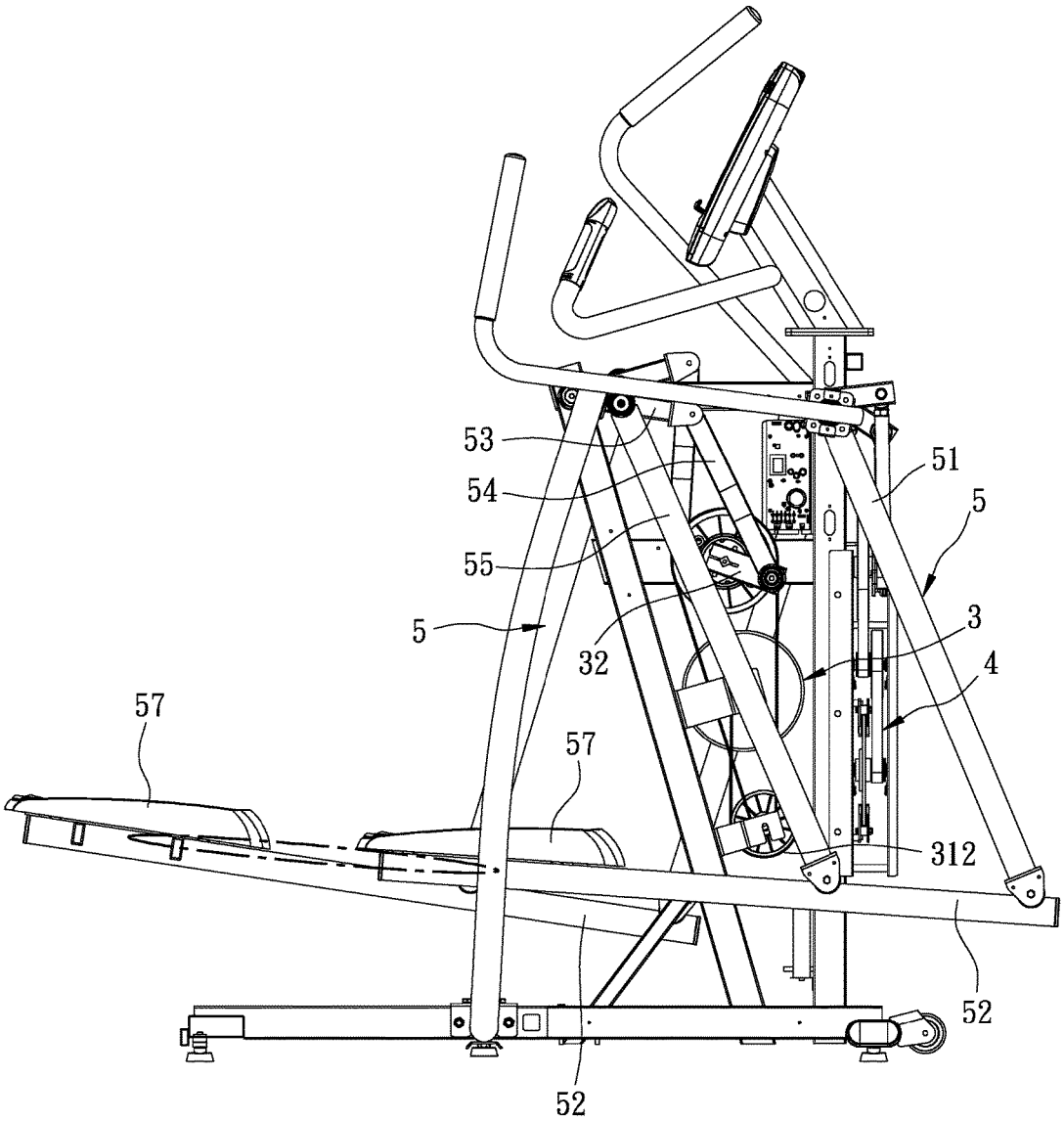
FIG. 5 is a side view illustrating the embodiment utilized to perform a first exercising mode.

Referring to FIG. 5, under a first exercising mode, the user stands on the foot pedals 57 and exerts forces on the foot pedals 57 to keep the pedal rods 52 parallel to each other. Then the pedal rods 52 are swung forwardly and rearwardly to actuate the first resisting unit 3 to generate the resistance applied to the pedal rods 52. Meanwhile, the handle rods 51 are swung forwardly and rearwardly to actuate the second resisting unit 4 to generate the resistance applied to the handle rods 51 so as to perform a walking exercising mode.

Figure 6:
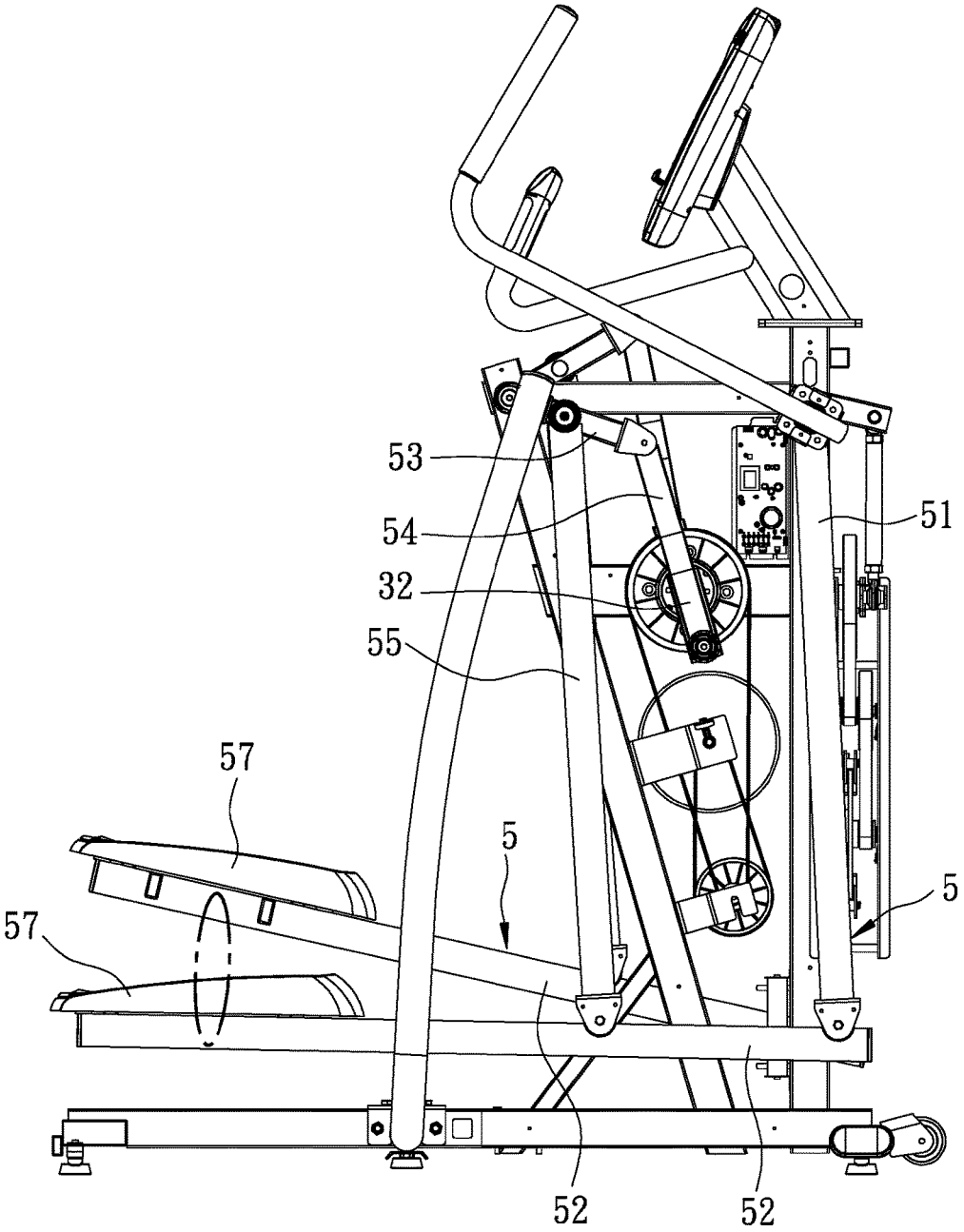
FIG. 6 is a side view illustrating the embodiment utilized to perform a second exercising mode.

Referring to FIG. 6, under a second exercising mode, the user stands on the foot pedals 57 and exerts a force on the foot pedals 57 to move one of the pedal rods 52 downwardly. The other one of the pedal rods 52 is moved upwardly by the respective crank 32, the respective first linking rod 54, the respective swing rod 53 and the respective second linking rod 55 such that the pedal rods 52 are moved in an upward-and-downward alternating manner. The handle rods 51 are swung forwardly and rearwardly with a relatively small span so as to perform a stair-climbing exercising mode.

Figure 7:
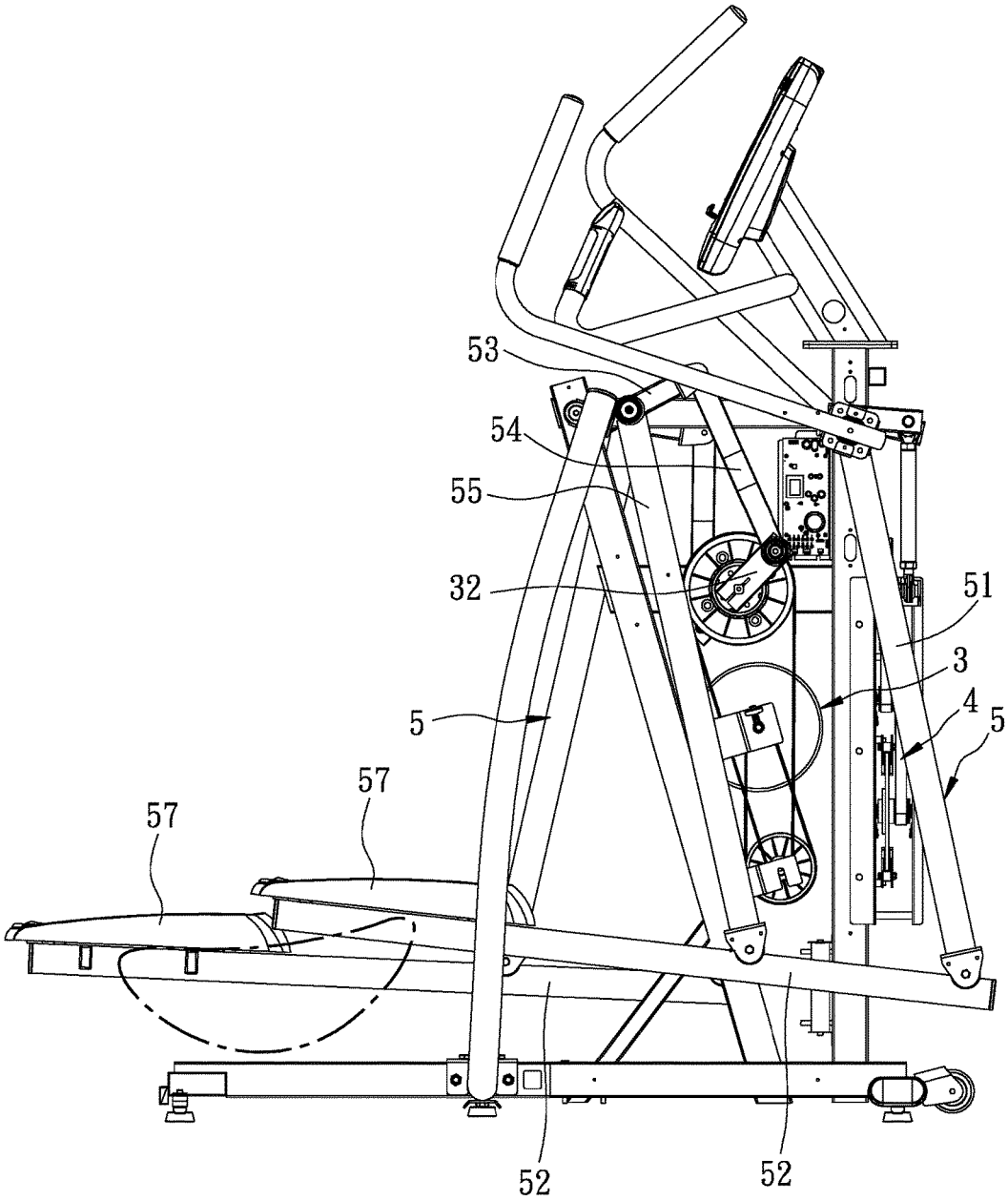
FIG. 7 is a side view illustrating the embodiment utilized to perform a third exercising mode.

Referring to FIG. 7, under a third exercising mode, when the user stands on the foot pedals 57 and exerts forces on the foot pedals 57 in an alternating manner, the pedal rods 52 are moved in an elliptical route and are subjected to the resistance by the first resisting unit 3. The handle rods 51 are swung forwardly and rearwardly in an alternating manner and are subjected to the resistance by the second resisting unit 4. In this state, the user's feet are enabled to travel along an elliptical route, and the user's arms are enabled to swing so as to simulate a running motion.

As illustrated, with the handle rods 51 not directly connected to the cranks 32 of the first resisting unit 3, the pedal rods 52 can generate a variety of moving routes by virtue of the user's feet and arms so as to perform different exercising modes. Moreover, with the first and second resisting units 3, 4 cooperating with the linking units 5, the pedal rods 52 and the handle rods 51 are respectively subjected to resistances by the first and second resisting units 3, 4 so as to train different muscle groups of the user and to enhance the feeling of comfort. Furthermore, the body exerciser according to the disclosure can perform a variety of operating modes that can be selected by the user without the need to change the structure of the body exerciser, which results in cost and space saving.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A body exerciser comprising:

a frame unit;

a first resisting unit including two cranks which are rotatably mounted on said frame unit, a first resisting member which is pivotably disposed on said frame unit, and a first transmitting mechanism which is connected between a respective one of said cranks and said first resisting member to permit synchronous rotation of said cranks and said first resisting member so as to provide a resistance to said cranks;

two linking units, each including a handle rod which is pivotably connected to said frame unit to be swingable forwardly and rearwardly, a pedal rod which has a front portion pivotably connected to a lower end of said handle rod and which extends rearwardly from said front portion to have a middle portion and a rear portion, a swing rod which is pivotably connected to said frame unit, a first linking rod which is pivotably connected to said swing rod and the respective one of said cranks, a second linking rod which is pivotably connected between said swing rod and said pedal rod, and a connecting member which is pivotably connected to said handle rod; and a second resisting unit including a second resisting member which is pivotably disposed on said frame unit, and a second transmitting mechanism which is connected between said connecting member and said second resisting member to provide a resistance to said handle rod through said connecting member.

2. The body exerciser as claimed in claim 1, wherein said frame unit includes a base and an upper front support disposed on a front side of said base, said upper front support including a front rod section which extends upwardly from said base, a rear rod section which extends upwardly from said base and which is disposed rearwardly of said front rod section, and a crosspiece section which is connected between said front and rear rod sections.

3. The body exerciser as claimed in claim 2, wherein said first transmitting mechanism has a first primary wheel which is pivotably connected to said crosspiece section, a first secondary wheel which is pivotably connected to said rear rod section, a first primary belt which is trained on said first primary and secondary wheels, and a first secondary belt which is trained on said first secondary wheel and said first resisting member, the respective one of said cranks being pivotably connected to said crosspiece section about an axis coaxial with that of said first primary wheel, said first resisting member being pivotably connected to said rear rod section.

4. The body exerciser as claimed in claim 2, wherein said second transmitting mechanism has a second primary wheel which is pivotably connected to said front rod section, a second secondary wheel which is pivotably connected to said front rod section, a second primary belt which is trained on said second primary and secondary wheels, and a second secondary belt which is trained on said second secondary wheel and said second resisting member, said second resisting member being pivotably connected to said front rod section.

5. The body exerciser as claimed in claim 4, wherein said handle rod of each of said linking units has a connecting portion which is pivotably connected to said front rod section and which has upper and lower ends, a handgrip portion which is securely connected to said upper end of said connecting portion, and an extending portion which is securely connected to and extends forwardly from said upper end of said connecting portion, said connecting member having an end which is pivotably connected to said extending portion, and an opposite end which is pivotably connected to either side of said second primary wheel to bring in alternately clockwise and counterclockwise turning of said second primary wheel during swinging of said handle rods of said linking units so as to provide the resistance to said handle rods.

6. The body exerciser as claimed in claim 1, wherein said second linking rod has a lower end pivotably connected to said middle portion of said pedal rod for cooperating with said handle rod to suspend said pedal rod.

7. The body exerciser as claimed in claim 6, wherein each of said linking units further includes a foot pedal disposed on said rear portion of said pedal rod.

8. The body exerciser as claimed in claim 2, wherein said frame unit further includes two lateral supports each connected between said base and an upper side of said rear rod section and extending laterally of said base.

9. The body exerciser as claimed in claim 1, wherein said connecting member has two ends which are pivotably connected to said handle rod and said second transmitting mechanism through universal bearings, respectively.

* * * * *